US009078492B2

(12) United States Patent
Koo

(10) Patent No.: US 9,078,492 B2
(45) Date of Patent: Jul. 14, 2015

(54) SHOE HAVING A CONTOURED BOTTOM WITH SMALL PARTICLES BONDED TO THE LOWEST EXTENDING PORTIONS THEREOF

(75) Inventor: John C. S. Koo, Los Angeles, CA (US)

(73) Assignee: Dynasty Footwear, Ltd., El Segundo, CA (US)

( * ) Notice: Subject to any disclaimer, the term of this patent is extended or adjusted under 35 U.S.C. 154(b) by 1605 days.

(21) Appl. No.: 10/613,741

(22) Filed: Jul. 3, 2003

(65) Prior Publication Data

US 2004/0194341 A1 Oct. 7, 2004

Related U.S. Application Data

(63) Continuation-in-part of application No. 10/438,375, filed on May 15, 2003, now Pat. No. 7,191,549.

(60) Provisional application No. 60/460,260, filed on Apr. 3, 2003.

(51) Int. Cl.

| | |
|---|---|
| ***A43B 13/02*** | (2006.01) |
| ***A43B 13/12*** | (2006.01) |
| ***A43B 13/14*** | (2006.01) |
| ***A43B 13/22*** | (2006.01) |

(52) U.S. Cl.

CPC ..... *A43B 13/02* (2013.01); *A43B 13/12* (2013.01); *A43B 13/223* (2013.01)

(58) Field of Classification Search

CPC ..... A43B 13/02; A43B 13/12; A43B 13/223; A43B 13/08; A43B 13/32

USPC ..... 36/59 C, 59 R, 8.1, 7.7, 7.6, 7.1 R, 113, 36/26, 132, 136; 427/200, 206

See application file for complete search history.

(56) References Cited

U.S. PATENT DOCUMENTS

| | | | | |
|---|---|---|---|---|
| 123,450 | A | 2/1872 | Bryant | |
| 140,241 | A | 6/1873 | Bryant | |
| 384,483 | A | 6/1888 | Walters | |
| 1,395,958 | A | 11/1921 | Hamilton | |
| 1,499,785 | A * | 7/1924 | Regula | 428/147 |
| 1,716,790 | A | 6/1929 | Mitchell | |
| 2,029,361 | A * | 2/1936 | Diller et al. | 264/112 |

(Continued)

FOREIGN PATENT DOCUMENTS

| | | |
|---|---|---|
| CN | 2353190 Y | 12/1999 |
| FR | 2617382 | 1/1989 |

(Continued)

OTHER PUBLICATIONS

May 29, 2003 Printout of web page at http://courses.che.umn.edu/00dha2213-1f/texana2213/nonwoven.html.

(Continued)

*Primary Examiner* — Jila M Mohandesi

(74) *Attorney, Agent, or Firm* — Joseph G. Swan, P.C.

(57) ABSTRACT

Provided is a shoe having a bottom surface that is adjacent to the ground in normal use and that has at least some indentations, with lower extending portions between the indentations. A sole forms at least a portion of the bottom surface, and an upper portion extends above the sole. A plurality of small particles is bonded to at least some of the lower extending portions, but at least a portion of the indentations is not coated with such small particles.

31 Claims, 2 Drawing Sheets

(56) References Cited

U.S. PATENT DOCUMENTS

| | | | | | |
|---|---|---|---|---|---|
| 2,075,229 | A | * | 3/1937 | Rose | 36/8.1 |
| 2,103,884 | A | * | 12/1937 | Wentworth | 523/167 |
| 2,114,300 | A | * | 4/1938 | Gustin et al. | 106/163.01 |
| 2,121,678 | A | | 6/1938 | Armor | |
| 2,144,330 | A | * | 1/1939 | Farrington | 12/142 F |
| 2,250,987 | A | * | 7/1941 | Dunbar | 36/59 R |
| 2,333,303 | A | | 11/1943 | Enos | |
| 2,362,378 | A | | 11/1944 | Holbrook et al. | |
| 2,393,433 | A | | 1/1946 | V'Soske | |
| 2,393,434 | A | | 1/1946 | V'Soske | |
| 2,400,487 | A | | 5/1946 | Clark | |
| 2,426,524 | A | | 8/1947 | Rosenbarger | |
| 2,427,882 | A | | 9/1947 | Schulte | |
| 2,570,949 | A | * | 10/1951 | Hoffenberg | 36/59 C |
| 2,640,283 | A | | 6/1953 | McCord | |
| 2,663,097 | A | * | 12/1953 | Giese, Jr. | 36/59 R |
| 2,732,065 | A | | 1/1956 | Marchese | |
| 2,736,926 | A | | 3/1956 | Johnson, Jr. et al. | |
| 2,793,136 | A | * | 5/1957 | Root | 428/147 |
| 3,027,661 | A | | 4/1962 | McCord | |
| 3,222,208 | A | * | 12/1965 | Bertollo | 427/245 |
| 3,303,250 | A | | 2/1967 | Bingham | |
| 3,543,420 | A | | 12/1970 | Dassler | |
| 3,555,697 | A | | 1/1971 | Dassler | |
| 3,629,051 | A | | 12/1971 | Mitchell | |
| 3,698,357 | A | | 10/1972 | Spencer | |
| 3,776,753 | A | | 12/1973 | Habib | |
| 3,798,048 | A | | 3/1974 | Brody et al. | |
| 3,824,715 | A | | 7/1974 | Vaughan, Jr. et al. | |
| 3,888,026 | A | | 6/1975 | Dassler | |
| 3,918,181 | A | * | 11/1975 | Inohara | 36/59 C |
| 4,007,549 | A | * | 2/1977 | Moore | 36/59 C |
| 4,015,347 | A | * | 4/1977 | Morishita et al. | 36/44 |
| 4,021,860 | A | | 5/1977 | Swallow et al. | |
| 4,050,168 | A | * | 9/1977 | Pace | 36/136 |
| 4,069,515 | A | | 1/1978 | Swallow et al. | |
| 4,089,069 | A | | 5/1978 | Vistins | |
| 4,108,452 | A | | 8/1978 | Baron | |
| 4,151,662 | A | | 5/1979 | Vistins | |
| 4,160,331 | A | | 7/1979 | Bell | |
| 4,172,293 | A | | 10/1979 | Vistins | |
| 4,217,704 | A | | 8/1980 | Whitaker | |
| 4,356,643 | A | * | 11/1982 | Kester et al. | 36/59 C |
| 4,374,460 | A | | 2/1983 | Towsend | |
| 4,405,730 | A | | 9/1983 | Cohen | |
| 4,489,510 | A | | 12/1984 | Williams | |
| 4,501,077 | A | * | 2/1985 | Young | 36/59 C |
| 4,519,148 | A | | 5/1985 | Sisco | |
| 4,535,121 | A | | 8/1985 | Oezelli et al. | |
| 4,554,749 | A | | 11/1985 | Ostrander | |
| 4,640,858 | A | | 2/1987 | Barnett | |
| 4,658,514 | A | * | 4/1987 | Shin | 36/59 C |
| 4,702,021 | A | | 10/1987 | Cameron | |
| 4,779,360 | A | * | 10/1988 | Bible | 36/7.7 |
| 4,825,564 | A | | 5/1989 | Sorce | |
| RE33,018 | E | | 8/1989 | Ostrander | |
| 4,879,969 | A | | 11/1989 | Haranoya et al. | |
| 4,924,608 | A | | 5/1990 | Mogonye | |
| 4,963,422 | A | | 10/1990 | Katz et al. | |
| 5,038,500 | A | * | 8/1991 | Nicholson | 36/59 C |
| 5,108,777 | A | | 4/1992 | Laird | |
| 5,259,125 | A | | 11/1993 | Gromes | |
| 5,263,233 | A | | 11/1993 | Kim et al. | |
| 5,276,981 | A | * | 1/1994 | Schaffer et al. | 36/59 R |
| 5,290,607 | A | | 3/1994 | Chitouras | |
| 5,403,638 | A | | 4/1995 | Yanagizawa et al. | |
| 5,403,884 | A | | 4/1995 | Perlinski | |
| 5,425,186 | A | * | 6/1995 | Hoyt | 36/7.1 R |
| 5,485,687 | A | | 1/1996 | Rohde | |
| 5,694,704 | A | | 12/1997 | Kasbrick | |
| 5,799,418 | A | | 9/1998 | Davis | |
| 5,921,005 | A | | 7/1999 | Bell et al. | |
| 6,055,748 | A | | 5/2000 | Harrison | |
| 6,106,920 | A | | 8/2000 | Pichon et al. | |
| 6,214,141 | B1 | | 4/2001 | Kim et al. | |
| 6,219,938 | B1 | | 4/2001 | Anderson | |
| 6,243,973 | B1 | | 6/2001 | Lind | |
| 6,255,235 | B1 | | 7/2001 | Hiraoka et al. | |
| 6,306,498 | B1 | | 10/2001 | Yuuki et al. | |
| 6,430,844 | B1 | | 8/2002 | Otis | |
| 6,766,536 | B1 | | 7/2004 | Aarons | |
| 6,782,642 | B2 | * | 8/2004 | Knoche et al. | 36/59 C |
| 2002/0035796 | A1 | | 3/2002 | Knoche et al. | |
| 2002/0133975 | A1 | | 9/2002 | Bernthal | |
| 2002/0148140 | A1 | | 10/2002 | Otis et al. | |
| 2002/0148141 | A1 | | 10/2002 | Otis et al. | |
| 2002/0152638 | A1 | | 10/2002 | Safdeye et al. | |
| 2002/0152639 | A1 | | 10/2002 | Otis et al. | |
| 2002/0157281 | A1 | | 10/2002 | Safdeye et al. | |
| 2002/0162248 | A1 | | 11/2002 | Otis et al. | |
| 2002/0166261 | A1 | | 11/2002 | Safdeye et al. | |
| 2003/0009919 | A1 | | 1/2003 | Stein | |
| 2004/0163190 | A1 | * | 8/2004 | Loughran | 36/59 R |

FOREIGN PATENT DOCUMENTS

| | | | | |
|---|---|---|---|---|
| GB | 2 201 082 | | 8/1988 | |
| JP | S59-362 | | 1/1984 | |
| JP | 02267014 | | 10/1990 | |
| JP | 03170101 | | 7/1991 | |
| JP | 06181801 | | 7/1994 | |
| NZ | 98234514.3 | | 12/1999 | |
| WO | WO 92/14372 | A1 * | 9/1992 | A43B 7/32 |

OTHER PUBLICATIONS

May 29, 2003 Printout of web page at http://courses.che.umn.edu/00dha2213-1f/texana2213/needlep.html.

May 29, 2003 Printout of web page at http://courses.che.umn.edu/00dha2213-1f/texana2213/felted.html.

May 29, 2003 Printout of web page at http://csm.utk.edu/textile/nonwovens/thermalbond.html (pp. 1-8).

May 29, 2003 Printout of web page at http://www.mjfibre.dk/airlaid_menu.htm.

May 29, 2003 Printout of web page at http://www.mjfibre.dk/airlaid_bonding.htm (pp. 1-4).

"Harmonized Tariff Schedule of the United States (2003)—Supplement 1", Section XII, Chapter 64, pp. 1-21.

Webpage at http://www.wisegeek.com/what-are-the-different-types-of-temporary-adhesive.htm, printed out on Aug. 4, 2010.

Webpage at http://www.wordiq.com/definition/Adhesive#Temporary_adhesives, printed out on Aug. 4, 2010.

Webpage at http://www.aircraftspruce.com/catalog/wppages/stickit.php, printed out on Aug. 4, 2010.

Webpage at http://www.sewforless.com/item/505_Temporary_Adhesive_Spray_Large_17_oz_Can/7391/c109, printed out on Aug. 4, 2010.

* cited by examiner

SHOE HAVING A CONTOURED BOTTOM WITH SMALL PARTICLES BONDED TO THE LOWEST EXTENDING PORTIONS THEREOF

Priority is claimed to U.S. Provisional Patent Application Ser. No. 60/460,260 titled "Flock-Bottomed Outdoor Shoe" filed on Apr. 3, 2003, and this application is a Continuation-in-Part of U.S. patent application Ser. No. 10/438,375, filed on May 15, 2003, and now issued as U.S. Pat. No. 7,191,549, which applications are incorporated herein by reference as though set forth herein in full.

BACKGROUND OF THE INVENTION

1. Field of the Invention

The present invention concerns footwear and is directed to an outdoor shoe having a bottom surface that is partially or wholly covered with particulate material.

2. Description of the Related Art

Surprisingly little variation has been provided in the construction of the bottom surface of conventional shoes. While some efforts have been made to utilize different materials in the construction of a shoe's outsole and/or heel, these efforts have provided only limited variation from the standard shoe, which has one or two pieces of material forming its bottom surface. As a result, certain textures, properties and appearances have not been available from conventional shoes.

One limitation of conventional shoes is that, although many different types of shoes have been available to consumers, each shoe generally is only useful for a single purpose. In this regard, for example, shoes can be categorized as either indoor shoes or outdoor shoes. Within each of these general categories are many subcategories.

Indoor shoes include various types of slippers, moccasins, slipper boots and similar types of softer and less durable shoes. Typically, the preferred characteristics of an indoor shoe include some combination of comfort, warmth and appearance. In addition, it generally is desirable for indoor shoes to have a soft bottom, so as not to scuff, scratch or otherwise damage hardwood or similar indoor floor surfaces. As a result, most indoor shoes are made entirely of soft fabrics and other soft materials.

Outdoor shoes, on the other hand, generally need to be capable of accommodating harsher surfaces and environments. Therefore, outdoor shoes usually are made of stronger and more durable materials, such as natural and/or synthetic leather, rubber and/or durable fabrics. Certain outdoor shoes have particular types of fibers flocked onto their bottom surfaces in order to provide anti-slip properties. See, e.g., Japanese Unexamined Patent Application Publication No. H3-170101, published Jul. 23, 1991. In any case, the sole of an outdoor shoe generally must be very strong and durable in order to protect the wearer's foot from rough or jagged ground surfaces. Outdoor shoes include, for example, a variety of dress shoes, casual shoes, tennis shoes, running shoes, work shoes and boots, sandals, thongs and sneakers. Generally speaking, a different combination of characteristics is desired for shoes in each of these subcategories.

The differences in the desired properties of indoor shoes versus outdoor shoes, as well as the differences among the various subcategories, conventionally have meant that any single shoe has been satisfactory for only a single purpose. That is, utilizing conventional shoe manufacturing techniques, it has been very difficult to provide a shoe that can be utilized for multiple different purposes.

SUMMARY OF THE INVENTION

However, the present inventor has recognized the desirability of a shoe that has different properties than can be provided by conventional shoes. For example, the present inventor has discovered that it often will be desirable to have a shoe that can be used for a time as an indoor shoe and then subsequently used as an outdoor shoe.

The present invention addresses these needs by providing a shoe having a contoured bottom shoe in which small particles are bonded to at least some of the lower extending portions, but at least a portion of the indentations is not coated with such small particles. As a result, the range of appearances, tactile properties and other properties that may be provided on the bottom surface of a shoe is greatly expanded. In one particular example described below, a shoe according to the present invention is appropriate for wearing indoors for a period of time and then outdoors on a long-term basis.

More specifically, the invention is directed to a shoe having a bottom surface that is adjacent to the ground in normal use and that has at least some indentations, with lower extending portions between the indentations. A sole forms at least a portion of the bottom surface, and an upper portion extends above the sole. A plurality of small particles is bonded to at least some of the lower extending portions, but at least a portion of the indentations is not coated with such small particles.

By providing small particles on the bottom surface of a shoe in this manner, the present invention can provide shoes that have multiple purposes. For example, a shoe according to the present invention having fabric particles bonded to its bottom surface might be used for a time as an indoor shoe and then subsequently used as an outdoor shoe.

In the preferred embodiments of the invention, the shoe's sole is sufficiently strong, durable (e.g., abrasion-resistant) and/or well-cushioned to permit the shoe to be commercially accepted as an outdoor shoe. Generally speaking, it is preferable to coat a significant part (e.g., all, substantially all, or at least a majority) of the ground-contacting portion of the bottom surface of the shoe with small particles.

In certain preferred embodiments, a temporary or weak adhesive is used to bond the small particles. As a result, the small particles may tend to wear away when the shoe is worn outdoors, with the rate of wear depending upon the nature of the small particles and the technique and/or materials used for bonding them to the bottom surface of the shoe.

The foregoing summary is intended merely to provide a brief description of the general nature of the invention. A more complete understanding of the invention can be obtained by referring to the claims and the following detailed description of the preferred embodiments in connection with the accompanying figures.

DESCRIPTION OF THE PREFERRED EMBODIMENT(S)

Figure 1:
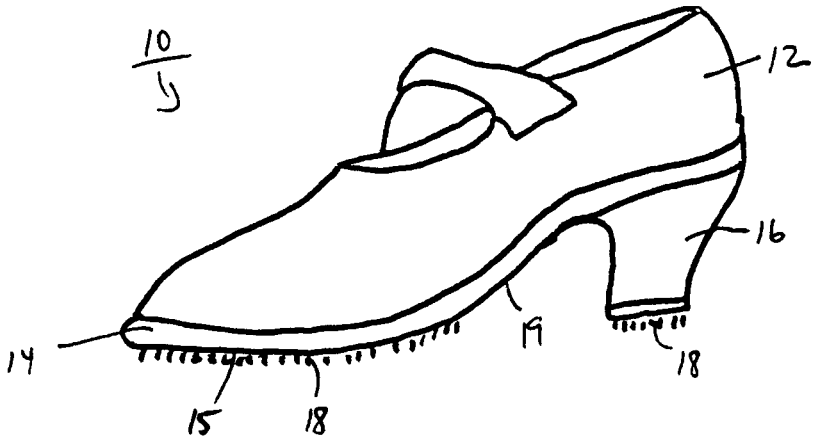
FIG. 1 illustrates a perspective view of a shoe according to a representative embodiment of the present invention.

Generally speaking, the present invention concerns a shoe having small particles bonded to its bottom surface. Such particles may be any of a variety of shapes, such as being thin fibers, cylindrical, ellipsoid, cubical, cuboid, other polyhedron or substantially spherical, with the chosen shape typically depending upon the type of material being utilized and the effect that is desired to be achieved. The most important aspect of such particles is their small size, and typically they will weigh less than 0.1, 0.01, 0.001, 0.0001, 0.00001 or even 0.000001 gram each, on average. In any event, it is preferable that such particles are small enough to permit a large number of distinct particles to be attached to the bottom surface of the shoe. Depending upon the amount of surface area to be covered and the size of the particle used, typically at least 100, 1,000, 10,000, 100,000 or 1,000,000 such particles will be used.

Generally speaking, such particles may be formed from any type of material. Examples include any of: wood (e.g., ground into dust or converted into pulp and then formed into small particles); paper (e.g., converted into pulp and then formed into small particles); leather (e.g., dried and ground into small particles); a composite leather and wood mixture; glass; natural or synthetic fibers; natural plant material (e.g., dried and ground into small particles or else cut or separated into small, thin fibers), natural or synthetic rubber, any of a variety of different types of metal (e.g., steel or aluminum), plastic, silicone, Styrofoam, or any other type of material, although natural and/or organic materials generally are preferred. In each case, the material preferably is ground, cut, broken or formed into small particles of a size appropriate for the intended purpose, e.g., any of the sizes listed above.

Generally speaking, the foregoing particles will adhere to the bottom surface of a shoe using a separate glue or other adhesive material. More preferably, the particles adhere to the bottom surface of the shoe using a relatively weak or temporary adhesive that will allow the particles to wear off within a fairly short period of outdoor use, such as within no more than approximately 2-3 days, approximately 2-3 weeks or approximately 2-3 months, on average when worn outdoors in an urban environment on a full-time basis (e.g., 8 hours per day).

In the preferred application process, adhesive material is applied (preferably, a liquid adhesive applied in a uniform manner) to the bottom surface of the shoe (i.e., that portion which is adjacent to the ground). Then, the particles are applied onto the bottom surface of the shoe using any of a variety of different techniques. For example, the particles may be (i) sprayed (e.g., using a compressed air spray) onto the bottom surface of the shoe; (ii) made airborne (e.g., by blowing the particles into the air or dropping them from an appropriate height) and then allowed to settle on the bottom surface of the shoe; or (iii) in a more specialized technique that generally will only be suitable for certain types of particles, flocked onto the bottom surface of the shoe. In any event, the particles preferably are applied in a controlled and/or predetermined manner in order to produce a uniform appearance of the particles on the bottom surface of the shoe. A certain amount of randomness may be part of such particle-application process, such as is present in flocking, spraying and allowing the particles to drift downwardly and settle; however, the process nevertheless preferably is controlled so is to produce a distribution having a uniform density (or at least a density having controlled variations).

In a somewhat modified technique, the particles are suspended in a solution which is then brushed on (or otherwise applied) and allowed to dry. Such a technique is similar to the way that felts and similar fabrics are manufactured.

The particles may be bonded directly to the bottom surface of the shoe or else may be first bonded to a separate substrate which is then bonded or otherwise attached to the bottom of the shoe. In the first case, a shoe may be manufactured in a conventional manner, and then the particles are bonded to its bottom surface (e.g., by coating with adhesive material and then applying the particles). In the latter case, the substrate typically will be a sheet of material (e.g., a thin sheet of EVA, PVC or TPR) to which the particles are bonded (e.g., by coating with adhesive material and then applying the particles), followed by a process in which the sheet material is bonded to the bottom surface of the shoe (e.g., using adhesive material or heat and/or pressure).

In either of the foregoing embodiments, the type of bonding used (for either attaching the particles or attaching the substrate (if used) to the shoe is not critical, but instead generally will depend in each situation upon external considerations, such as price, desired physical properties, etc. Such bonding may constitute or include, for example, either or both of gluing or application with the use of heat and/or pressure (as to the latter, e.g., inserting the particles into a mold that is used to form the substrate or the bottom of the shoe or inserting the substrate with particles bonded into a mold that is used to form the bottom of the shoe).

In the preferred embodiment of the invention, the shoe has a strong and/or durable outsole. One advantage of such a shoe is that it can be used for a time as an indoor shoe and then subsequently used as an outdoor shoe. When initially worn indoors, such a shoe preferably will have a relatively soft fabric bottom (primarily due to the flocking with fabric or other fibers), thereby preventing the surface of indoor floors from becoming scratched, scuffed or otherwise damaged. Then, when worn outdoors the small particles (e.g., flocking material) generally will tend to wear away rather quickly, thereby exposing the more durable outsole of the shoe.

Thus, a shoe of the present invention preferably is constructed primarily for outdoor use, but has a bottom that is at least partially covered with small particles, such as flocking material. There are several well-known distinctions between indoor and outdoor shoes. For example, outdoor shoes typically have significantly more durable bottoms and therefore are capable of being worn outdoors for a long period of time, such as for eight hours a day over a period of one month, two months, four months, eight months or even more than a year, without sustaining wear that would unduly affect the comfort and/or protection provided by the shoe. On the other hand, an indoor shoe generally has a much less durable bottom which would wear out quickly if worn outdoors for any extended period of time.

One commonly used test for determining the durability of a shoe's outsole is ASTM-D1630(NBS) which measures resistance to abrasion and which is promulgated by the American Society for Testing and Materials (ASTM). A shoe according to the present invention preferably has an outsole having a resistance to abrasion, as measured by ASTM-D1630(NBS), of at least 15 percent, 25 percent, 35 percent, 45 percent, 60 percent, 80 percent, 100 percent, 150 percent or 200 percent.

Another distinction between outdoor and indoor shoes is that outdoor shoes typically have outsoles that are much stronger than the outsoles provided on indoor shoes. A strong outsole is highly desirable in an outdoor shoe in order to protect the wearer's foot from injury caused by sharp objects, jagged terrain and similar hazards. Such hazards are a much less significant concern with respect to indoor footwear. One standardized test for determining the strength of an outsole is ASTM-D624 which measures tear resistance. The outsole of a shoe according to the present invention preferably has a tear resistance, as measured by ASTM-D1630(NBS), of at least 4 kilograms(kg)/centimeter(cm), 6 kg/cm, 9 kg/cm 12 kg/cm, 15 kg/cm, 20 kg/cm or 25 kg/cm.

A further distinction between outdoor and indoor shoes is that an outdoor shoe generally must have more cushioning than an indoor shoe, in order to provide adequate comfort when the wearer walks across the variety of different hard and/or rough surfaces that frequently are encountered in connection with outdoor use. Most indoor shoes would not provide a commercially acceptable level of comfort when worn in normal use outdoors.

A still further distinction between indoor and outdoor shoes is that an outdoor shoe typically protects the wearer's foot much more than an indoor shoe would from a number of different elements, such as heat, cold and moisture. Thus, for example, an outdoor shoe might be impervious to water, might provide sufficient thermal insulation to keep the wearer's foot warm even worn in temperatures below 32 degrees Fahrenheit (° F.), 20° F. or even 10° F.

A variety of different designs and materials may be utilized in the construction of an outdoor shoe. For example, the shoe's outsole may be made from any of a variety of different materials, including a rubbery material (e.g., cured natural rubber, thermoplastic rubber (TPR), or any other synthetic rubber), natural or a synthetic leather, ethylene vinyl acetate (EVA), a polyurethane elastomer, polyvinyl chloride (PVC), any other plastic materials, and/or any other suitable materials. An outdoor shoe according to the present invention preferably has an outsole that is comprised of at least ¼ inch thick, ⅜ inch thick or ½ inch thick of a plastic material; at least ¼ inch thick, ⅜ inch thick or ½ inch thick of a rubbery material (e.g., natural or synthetic rubber); or at least ⅛ inch thick, 3/16 inch thick or ¼ inch thick of a more rigid or less pliable material, such as natural or synthetic leather. As a further alternative, the shoe's outsole may be constructed from wood and then coated with plastic.

The following description generally concerns a specific embodiment of the present invention in which natural or synthetic fibers are flocked onto the bottom surface of a shoe. A similar flocking technique may be used to apply a variety of other types of particles, as well. Also, although the following example illustrates certain generally applicable concepts and variations on the present invention, it should be understood that a variety of other types of particles and a variety of other types of techniques for applying them (e.g., using any or all of the following concepts and techniques) may instead be utilized.

Flock-Bottomed Shoe.

As indicated above, a shoe according to the present invention preferably has the same appearance as a conventional shoe, except that at least a portion of its bottom surface is coated with flocking material. Of course, in alternate embodiments of the invention, other small particles attached in any of a variety of other ways, as described in more detail above, may be substituted for such flocking material. Accordingly, references below to flocking or to flocking material generally may also applied to such other small particles.

FIG. 1 illustrates a perspective view of a shoe 10 according to a representative embodiment of the present invention. As shown in FIG. 1, shoe 10 includes the conventional features of a shoe, such as an upper portion 12, a sole 14 and a heel 16. It is noted that sole 14 may be comprised of separate components, such as a separate insole (the portion upon which the wearer's foot rests) and a separate outsole (the bottom portion of the shoe 10, other than the heel 16). Alternatively, the insole and outsole of sole 14 may form a single unitary piece, in which case references to either the insole or the outsole refer to that single unitary piece. The upper 12 may be attached to the sole 14 using stitching, gluing, a combination of the two, or any other known technique.

In the illustrated embodiment, the portion 15 of the bottom surface of shoe 10 that normally comes in contact with the ground (i.e., the ground-contacting portion) consists of the entire bottom surface of heel 16 and the portion of the bottom surface of sole 14 that extends approximately from the middle to the front of sole 14. As further shown in FIG. 1, such ground-contacting portion of the bottom surface of shoe 10 is coated with a flocking material 18. At the same time, the portion 19 of the sole 14 that normally does not come in contact with the ground (i.e., the non-ground-contacting portion) is not coated with flocking material 18.

Figure 2:
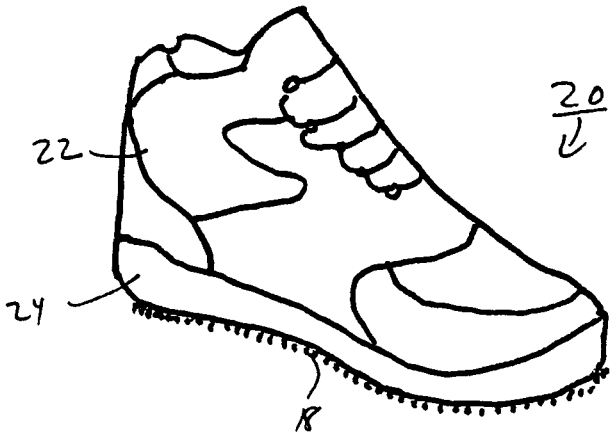
FIG. 2 illustrates a perspective view of a shoe according to an alternative embodiment of the present invention.

FIG. 2 illustrates an alternative embodiment of a shoe 20 according to the present invention. As shown in FIG. 2, shoe 20 also includes an upper portion 22 and a sole 24, but no separate heel. In this embodiment of the invention as well, the ground-contacting portion of the bottom surface of shoe 20 is coated with flocking material 18. In this case, however, because the entire bottom surface of shoe 20 is flat, the entire bottom surface of shoe 20 is covered with such flocking material 18. As described in more detail below, if the bottom surface of shoe 20 has grooves, recesses or other indentations (i.e., is contoured), it is possible to coat only the ground-contacting portion of such bottom surface with flocking material or to coat the entire bottom surface of shoe 20 with flocking material, or any combination thereof.

In still further alternative embodiments of the invention, it is not necessary to coat the entire ground-contacting portion of the bottom surface of a shoe with flocking material. Rather, only some part of the ground-contacting portion of the shoe's ground-contacting surface might be covered with flocking material. In the preferred embodiment of the invention, a substantial part of the ground-contacting portion of the bottom surface of the shoe is covered with fabric flocking material. More preferably, at least 50, 60, 70, 80 or 90 percent of the area upon which the shoe normally contacts the ground is fabric material.

Preferably, all of such ground-contacting fabric area has been achieved by flocking. However, it is also possible to use other techniques (e.g., any of the techniques described above, molding fabric material into the shoe's outsole or gluing fabric material to the bottom of the shoe) in connection with the flocking to achieve these desired percentages. The specific combination of techniques utilized, as well as the amount and configuration of flocked areas, generally will be dictated by the desired aesthetic effect and/or by functional requirements.

Figure 3A:
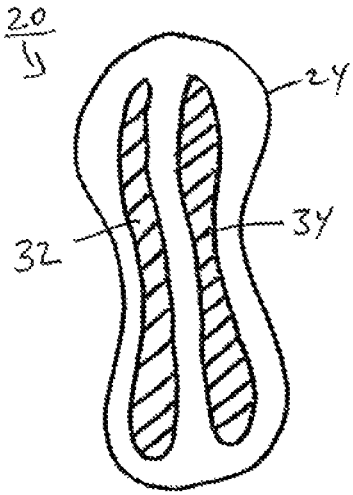
FIGS. 3A and 3B show plan views of the bottom surface of a shoe according to a representative embodiment of the invention.

One example in which only a part of the ground-contacting portion of the shoe's bottom surface is coated with flocking material is illustrated in FIG. 3A, which shows a plan view of the bottom surface of shoe 20. As shown in FIG. 3A, only the left portion 32 and the right portion 34 of the bottom surface of sole 24 are coated with flocking material 18. Where such partial flocking is utilized, it is not critical that any particular areas be coated with flocking material 18. Instead, flocking material 18 may be applied in any desired pattern.

Figure 3B:
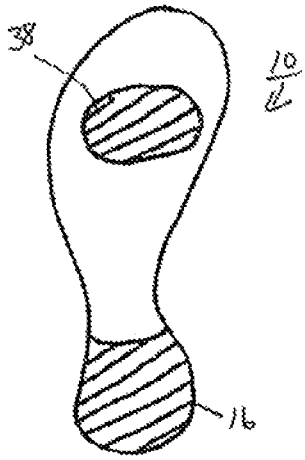

Another example of such partial flocking is shown in FIG. 3B, which illustrates the bottom plan view of shoe 10. In this example, the entire bottom surface of heel 16 is coated with flocking material 18. However, only a portion 38 of the ground-contacting bottom surface of sole 14 is coated with flocking material 18. Once again, the specific arrangement of flocking material in any particular embodiment may be selected to achieve any desired aesthetic effect and/or any functional objectives, such as comfort and/or slip resistance.

Any conventional flocking technique may be utilized to achieve the flocking material patterns discussed above. Generally speaking, flocking involves coating a desired surface with an adhesive material, placing the article to be flocked into a chamber together with short airborne fabric fibers, and taking steps to cause of the fibers (or other elongated particles) to embed into the surface at a right angle. The most common techniques for achieving this latter result include electrostatically charging the fabric fibers and/or mechanically beating the article to be flocked (typically used when flocking a sheet material). Frequently, a combination of these two techniques is utilized. Specific techniques and materials for applying flocking material to objects are well-known and are described, for example, in U.S. Pat. No. 4,535,121 (Ozelli), U.S. Pat. No. 4,879,969 (Haranoya), U.S. Pat. No. 4,963,422 (Katz), U.S. Pat. No. 5,108,777 (Laird), U.S. Pat. No. 6,106,920 (Pichon), U.S. Pat. No. 6,214,141 (Kim), U.S. Pat. No. 3,776,753 (Habib), and U.S. Pat. No. 4,640,858 (Barnett); each of which is incorporated by reference herein as though set forth herein in full.

In the preferred embodiment of the invention, the flocking material is applied directly to the material otherwise forming the bottom surface of the heel and/or to the material otherwise forming the bottom surface of the outsole of the subject shoe. Preferably, this is done before the upper of the shoe is attached to the heel and/or outsole. However, it is also possible to apply the flocking material to the bottom of the shoe after the shoe has been fully constructed. Still further, the flocking material may be applied at any other point during construction of the shoe. In any event, where the flocking material is applied directly to the bottom surface of the shoe (i.e., by flocking such bottom surface), the use of electrostatic flocking generally is preferred.

In certain embodiments of the invention, the flocking material first is applied to a fabric backing or other sheet material (e.g., EVA, PVC or TPR). Then, such fabric backing or other sheet material is glued or otherwise bonded onto the bottom surface of the shoe's heel and/or outsole. Alternatively, such a fabric backing or sheet material may be inserted into the mold (e.g., in connection with an injection molding process or, as described in the '322 application, a stamping process) when forming the shoe's outsole. In either case, pieces of the flocked fabric or other sheet material may be applied in any desired pattern and, in fact, different types of flocked sheet material (e.g., using different colors of flock fibers, different types of flock fibers, or different types of sheet material) may be applied to different locations on the bottom surface of the shoe.

In certain embodiments, the manufacture of a separate fabric or other sheet material with a flocked surface and then the utilization of such a flocked sheet material in the construction of the shoe's outsole and/or heel may be more cost efficient than flocking the shoe's bottom surface after the outsole, heel, or even the entire shoe, has been fully constructed. In such a case, an entire sheet of material may be flocked and then cut into pieces, each of which being sized and shaped appropriately for a corresponding component of the bottom surface of the shoe.

For example, pieces may be cut in the size and shape of: the entire outsole, a portion of the outsole, the entire bottom surface of the heel, or any combination of the foregoing. When manufacturing flocked sheet material for use in the construction of a shoe, the flocked material may be applied prior to or after any appropriate shaping of the surface of the material (e.g., the creation of any desired grooves, recesses or other indentations, in any desired pattern). If applied afterward, then the flocking material may be applied only to the lowest extending portions of the material's surface or to the entire surface of such sheet material, e.g., by selectively applying you the adhesive material in the manner described below. In addition, after such flocking, and either before or after incorporation of such flocked sheet material into the corresponding shoe, some or all of the flocked material may be ground off in any desired pattern.

With regard to the partial flocking mentioned above, many shoes have contoured or three-dimensional patterns on their bottom surfaces. With regard to such shoes, the adhesive may be applied (e.g., by spraying, brushing, rolling or dipping) such that the entire contoured surface is coated. Alternatively, the adhesive may be applied (e.g., by brushing, rolling or dipping) such that only to the lowest extending portions of the surface (i.e., those portions that normally would come into contact with the ground) are coated.

Figure 4:
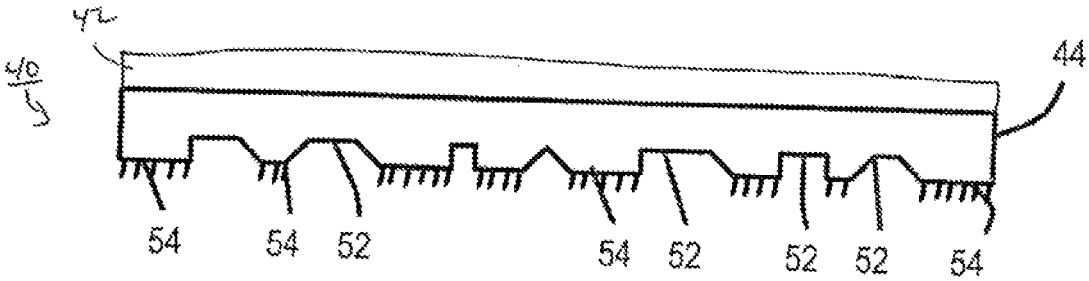
FIG. 4 illustrates a portion of a cross-section of a shoe outsole in accordance with a representative embodiment of the invention.

An advantage of this latter technique is illustrated in FIG. 4, which shows a portion of a cross-section of a shoe sole 40 that includes an insole 42 and an outsole 44. As shown in FIG. 4, the bottom portion of outsole 44 includes multiple indentations (or indented surface area) 52. Typically, such indentations 52 will be closely spaced and/or a very narrow, with multiple (e.g., 2, 5, 10 or more) such indentations 52 occurring when traversing the bottom of the shoe sole 40 from side to side and/or from front to back. Often, the indentations 52 will be approximately 1-2 millimeters (mm) in width and/or separated from each other by no more than approximately 1-2 mm of lower extending portions 54. However, any desired widths and/or spacings may be used.

By brushing or rolling adhesive onto only the lowest extending parts 54 of the bottom portion of outsole 44, and avoiding applying the adhesive into such indentations 52, it generally will be easier to ensure that flocking material only will adhere to such lowest extending parts 54. Similarly, by dipping the outsole 44 into a thin layer of adhesive, generally only such lowest extending parts 54 will be coated with adhesive and, therefore, ultimately coated with flocking material 18. As a result, typically after only a short amount of outdoor use nearly all of such flocking material will wear away. This effect can be accentuated by using a week or temporary adhesive in connection with the flocking (or any other application of the small particles).

It is noted that brushing, rolling or dipping allows one to only coat the lowest extending portions 54 with adhesive, with the result that only such lowest extending portions 54 ultimately are covered with the small particles. Another technique for accomplishing the same result is to place against the bottom of the shoe, prior to applying the adhesive, a template which is the three-dimensional reverse of the pattern on the bottom of the shoe. In this way, the template fills in the indentations 52, preventing them from being coated with adhesive during the adhesive-application process. Once the adhesive has been applied, the template can be removed and, in certain embodiments, reused for another shoe.

On the other hand, by applying adhesive both to the lowest extending parts 54 and to the indentations 52 (e.g., by spraying, dipping, rolling or brushing), the entire bottom surface of the subject portion of outsole 44 generally will be coated with flocking material 18. Then, when ultimately used outdoors only the flocking material on the lowest extending parts 54 generally will wear away. In certain embodiments, it may be visually undesirable to then have only the indentations 52 coated with flocking material 18. In other embodiments, however, depending upon the particular ornamental design of the bottom surface of the shoe, such partial wearing away of the flocking material 18 might actually result in a pleasing aesthetic effect. Moreover, the same shoe might have areas of the bottom surface coated with flocking material only on the lowest extending portions 54 and other areas where both the lowest extending portions 54 and the indications 52 are coated with flocking material, in order to achieve a desired combination of these two different aesthetic effects.

Once the flocking material (or other small particles) have been applied, it may be desirable to grind the fibers or other particles to a desired depth.

Additional Considerations.

In the foregoing example, particles of a particular type (fibers) are attached to the bottom surface of a shoe using a flocking technique. In that description, certain variations are described. Except to the extent that such variations are specific to the use of fibers or to flocking, it is intended that such variations also are possible in techniques where other types of particles are applied to the bottom surface of a shoe.

Various types of adhesive may be used for adhering the small particles to the bottom surface of the shoe. Generally, the selection of the specific adhesive will be based upon the desired effect (e.g., rigid adherence or a more flexible, rubber-like adherence) and also based upon the type, size and shape of the particles used. In addition, it is not strictly necessary to use a separate adhesive material. Instead, the particles may be in bonded to the bottom surface of the shoe by using heat and/or pressure to embed such particles into the bottom surface. Such a method may be preferable where the surface is comprised of a rubber-like substance.

In certain instances in the description of the invention and in the claims, the terms "insole" and "outsole" are used. However, as noted above, in certain embodiments of the invention there may be no clear distinction between the shoe's insole and its outsole, such as in embodiments where those parts of the shoe are integrated into a single unitary peace. Unless the context clearly requires otherwise, use of the term insole or the term outsole is not meant to imply that such part is provided as a separately distinguishable component.

In the embodiments described above, the shoe has a relatively durable sole and is constructed in a matter so as to be appropriate for outdoor use. However, this is not critical to the invention. Indoor and other softer, less durable soled shoes also will benefit from the application of flocking material to their bottom surfaces, e.g., using any of the techniques described above. Moreover, although an enclosed shoe is illustrated in each of the accompanying figures, it should be understood that that the present invention also applies to sandals, thongs and other open-toe shoes. More generally, flocking fibers may be advantageously applied (e.g., as described herein) to the bottom surface of any type of shoe having any type of sole.

Also, several different embodiments of the present invention are described above, with each such embodiment described as including certain features. However, it is intended that the features described in connection with the discussion of any single embodiment are not limited to that embodiment but may be included and/or arranged in various combinations in any of the other embodiments as well, as will be understood by those skilled in the art.

Thus, although the present invention has been described in detail with regard to the exemplary embodiments thereof and accompanying drawings, it should be apparent to those skilled in the art that various adaptations and modifications of the present invention may be accomplished without departing from the spirit and the scope of the invention. Accordingly, the invention is not limited to the precise embodiments shown in the drawings and described above. Rather, it is intended that all such variations not departing from the spirit of the invention be considered as within the scope thereof as limited solely by the claims appended hereto.

What is claimed is:

1. A shoe comprising:

(a) a bottom surface that is adjacent to the ground in normal use and that has a plurality of indentations, with lower extending portions between the indentations;

(b) a sole that forms at least a portion of the bottom surface;

(c) an upper portion extending above the sole; and (d) a plurality of small particles bonded to at least some of the lower extending portions, but wherein each of the plurality of indentations is predominantly uncoated with said small particles, wherein the small particles comprise at least one of wood and paper.

2. A shoe according to claim 1, wherein at least 1,000 small particles are bonded to the at least some of the lower extending portions.

3. A shoe according to claim 1, wherein the small particles are bonded to the at least some of the lower extending portions using adhesive material.

4. A shoe according to claim 1, wherein the small particles are bonded to the at least some of the lower extending portions by embedding the small particles directly into said bottom surface using at least one of heat and pressure.

5. A shoe according to claim 1, wherein the small particles comprise wood.

6. A shoe according to claim 1, wherein the small particles comprise paper.

7. A shoe according to claim 1, wherein the small particles have been bonded directly onto the at least some of the lower extending portions.

8. A shoe according to claim 1, wherein the sole is sufficiently durable for commercially acceptable outdoor use.

9. A shoe according to claim 1, wherein the sole includes an outsole having an ASTM-D624 tear resistance of at least 6 kilograms per centimeter.

10. A shoe according to claim 1, wherein the sole includes an outsole having an ASTM-D624 tear resistance of at least 9 kilograms per centimeter.

11. A shoe according to claim 1, wherein the sole includes an outsole having an ASTM-D624 tear resistance of at least 15 kilograms per centimeter.

12. A shoe according to claim 1, wherein the sole includes an outsole having an ASTM-D1630(NBS) abrasion resistance of at least 25%.

13. A shoe according to claim 1, wherein the sole includes an outsole having an ASTM-D1630(NBS) abrasion resistance of at least 35%.

14. A shoe according to claim 1, wherein the sole includes an outsole having an ASTM-D1630(NBS) abrasion resistance of at least 45%.

15. A shoe according to claim 1, wherein the sole includes an outsole that is comprised of at least one of leather, natural rubber and synthetic rubber.

16. A shoe according to claim 1, wherein with the small particles cover at least 50% of the portion of the bottom surface that normally comes into contact with the ground.

17. A shoe according to claim 1, wherein the bottom surface has at least five of said indentations.

18. A shoe according to claim 1, wherein at least some of said indentations are very narrow.

19. A shoe according to claim 1, wherein at least one of said indentations is approximately 1-2 millimeters in width.

20. A shoe according to claim 1, wherein at least some of said indentations are closely spaced.

21. A shoe according to claim 1, wherein at least two of said indentations are separated from each other by no more than approximately 2 millimeters.

22. A shoe comprising:

(a) a bottom surface that is adjacent to the ground in normal use and that has a plurality of indentations, with lower extending portions between the indentations;

(b) a sole that forms at least a portion of the bottom surface;

(c) an upper portion extending above the sole; and (d) a plurality of small particles bonded to at least some of the lower extending portions, but wherein each of the plurality of indentations is predominantly uncoated with said small particles, wherein the small particles are bonded using a temporary adhesive that allows the particles to wear off during normal outdoor use;

wherein the temporary adhesive allows the particles to wear off within no more than 3 days when worn outdoors in an urban environment on a full-time basis.

23. A shoe comprising:

(a) a bottom surface that is adjacent to the ground in normal use and that has a plurality of indentations, with lower extending portions between the indentations;

(b) a sole that forms at least a portion of the bottom surface;

(c) an upper portion extending above the sole; and (d) a plurality of small particles bonded to at least some of the lower extending portions, but wherein each of the plurality of indentations is predominantly uncoated with said small particles, wherein the small particles are bonded using a temporary adhesive that allows the particles to wear off during normal outdoor use;

wherein the temporary adhesive allows the particles to wear off within no more than 3 weeks when worn outdoors in an urban environment on a full-time basis.

24. A shoe comprising:

(a) a bottom surface that is adjacent to the ground in normal use and that has a plurality of indentations, with lower extending portions between the indentations;

(b) a sole that forms at least a portion of the bottom surface;

(c) an upper portion extending above the sole; and (d) a plurality of small particles bonded to at least some of the lower extending portions, but wherein each of the plurality of indentations is predominantly uncoated with said small particles, wherein the small particles are bonded using a temporary adhesive that allows the particles to wear off during normal outdoor use;

wherein the temporary adhesive allows the particles to wear off within no more than 3 months when worn outdoors in an urban environment on a full-time basis.

25. A shoe comprising:

(a) a bottom surface that is adjacent to the ground in normal use and that has a plurality of indentations, with ground-contacting portions between the indentations;

(b) a sole that forms at least a portion of the bottom surface;

(c) an upper portion extending above the sole; and (d) a plurality of small particles bonded differentially to different areas of the bottom surface, with each of a plurality of the ground-contacting portions being coated more than each of the plurality of indentations, wherein the small particles comprise at least one of wood and paper.

26. A shoe according to claim 25, wherein the small particles are bonded to the different areas of the bottom surface using adhesive material.

27. A shoe according to claim 25, wherein the small particles are bonded to the different areas of the bottom surface by embedding the small particles directly into said different areas using at least one of heat and pressure.

28. A shoe according to claim 25, wherein the small particles comprise wood.

29. A shoe according to claim 25, wherein the small particles comprise paper.

30. A shoe according to claim 25, wherein the indentations ordinarily do not contact the ground in normal use.

31. A shoe according to claim 25, wherein the sole is sufficiently strong for commercially acceptable outdoor use.

* * * * *